US008908266B2

(12) United States Patent
Skinner

(10) Patent No.: US 8,908,266 B2
(45) Date of Patent: Dec. 9, 2014

(54) SOURCE SPECTRUM CONTROL OF NONLINEARITIES IN OPTICAL WAVEGUIDES

(75) Inventor: Neal G. Skinner, Lewisville, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 589 days.

(21) Appl. No.: 13/308,816

(22) Filed: Dec. 1, 2011

(65) Prior Publication Data

US 2013/0140039 A1 Jun. 6, 2013

(51) Int. Cl.
*H01S 3/00* (2006.01)

(52) U.S. Cl.
USPC ..... 359/349; 175/16; 385/100

(58) Field of Classification Search
USPC ..... 175/11, 57, 16; 219/121.6; 385/100; 359/344, 349
See application file for complete search history.

(56) References Cited

U.S. PATENT DOCUMENTS

| | | | | |
|---|---|---|---|---|
| 5,166,821 | A | 11/1992 | Huber | |
| 5,566,381 | A | 10/1996 | Korotky | |
| 6,252,693 | B1 | 6/2001 | Blauvelt | |
| 6,516,113 | B1 | 2/2003 | Glingener et al. | |
| 6,542,683 | B1 | 4/2003 | Evans et al. | |
| 7,580,630 | B2 | 8/2009 | Kee et al. | |
| 8,701,794 | B2 * | 4/2014 | Zediker et al. | 175/16 |
| 2008/0130097 | A1 | 6/2008 | McKinstrie | |
| 2010/0044106 | A1 | 2/2010 | Zediker et al. | |
| 2010/0215326 | A1 | 8/2010 | Zediker et al. | |
| 2013/0112478 | A1 * | 5/2013 | Braga et al. | 175/16 |

OTHER PUBLICATIONS

R. G. Smith; "Optical Power Handling Capacity of Low Loss Optical Fibers as Determined by Stimulated Raman and Brillouin Scattering", Applied Optics vol. 11, No. 11, pp. 2489-2494, dated Nov. 1972, 6 pages.

Halliburton; "FiberWatch Service", Article H07778, dated Jan. 2011, 2 pages.

E. P. Ippen and R. H. Stolen; "Simulated Scattering in Optical Fibers", Bell Telephone Laboratories Inc.,Holmdel, N. J. 07735, p. 549, dated 1971, 1 page.

Toshihiko Arai, Tadaichi Yabumoto, and Toshio Goto; "Mechanisms of the Increase of the Cd(II) 441.6 nm Laser Power by the Addition of Iodine in a Positive Column He-Cd Laser", IEEE Journal of Quantum Electronics, vol. QE-14, No. 5, pp. 374-377, dated May 1978, 4 pages.

George I. Stegeman and Roger H. Stolen; Nonlinear Guided-Wave Phenomena:, J. Opt. Soc. Am. B/vol. 5, No. 2, p. 264, dated Feb. 1988, 4 pages.

(Continued)

*Primary Examiner* — Mark Hellner
(74) *Attorney, Agent, or Firm* — Smith IP Services, P.C.

(57) ABSTRACT

A method of delivering a desired relatively high optical power to a well tool in a subterranean well can include coupling to an optical waveguide an optical source which combines multiple optical frequency ranges, respective centers of the frequency ranges being separated by at least a peak shift frequency in a Raman gain spectrum for a corresponding pump wavelength generated by the optical source, and transmitting the desired optical power to the well tool via the optical waveguide positioned in the well. Another method of delivering optical power to a well tool in a subterranean well can include coupling to an optical waveguide an optical source, the optical source comprising a sufficient number of lasing elements to transmit the optical power, with the optical power being greater than a critical power for stimulated Brillouin scattering in the waveguide.

22 Claims, 9 Drawing Sheets

(56) References Cited

OTHER PUBLICATIONS

A. M. Weiner, J P. Heritage, and R. H. Stolen; "Self-phase Modulation and Optical Pulse Compression Influenced by Stimulated Raman Scattering in Fibers", J. Opt. Soc. Am. B/vol. 5, No. 2, pp. 364-372, dated Feb. 1988, 9 pages.
R. H. Stolen, J. P. Gordon, W. J. Tomlinson, and H. A. Haus; "Raman Response Function of Silica-Core Fibers", J. Opt. Soc. Am. B/vol. 6, No. 6, pp. 1159-1166, dated Jun. 1989, 8 pages.
R. H. Stolen; "Relation between the Effective Area of a Single-Mode Fiber and the Capture Fraction of Spotaneous Raman Scattering", J. Opt. Soc. Am. B/vol. 19, No. 3, pp. 498-501, dated Mar. 2002, 4 pages.
R. H. Stolen, and W. J. Tomlinson; "Effect of the Raman Part of the Nonlinear Refractive Index on Propagation of Ultrashort Optical Pulses in Fibers", J. Opt. Soc. Am. B/vol. 9, No. 4, pp. 656-574, dated Apr. 1992, 9 pages.
G. I. Stegeman, and R. H. Stolen; "Waveguides and Fibers for Nonlinear Optics", J. Opt. Soc. Am. B/vol. 6, No. 4, pp. 652-661, dated Apr. 1989, 11 pages.
A. Boh Ruffin; "Simulated Brillouin Scattering: An Overview of Measurements, System Impairments, and Applications", NIST-SOFM, dated 2004, 6 pages.
G. P. Agrawal; Chapter 8 "Stimulated Raman Scattering", Nonlinear Fiber Optics(4th edition), dated 1989, 50 pages.
G. P. Agrawal; Chapter 9 "Stimulated Brillouin Scattering", Nonlinear Fiber Optics(4th edition), dated 1989, 34 pages.
R. H, Stolen; "Nonlinearity in Fiber Transmission", Proceedings of the IEEE, vol. 68, No. 10, pp. 1232-1236, dated Oct. 1980, 5 pages.
International Search Report and Written Opinion issued Mar. 29, 2013 for PCT Patent Application No. PCT/US2012/065732, 10 pages.
Australian Examination Report issued Jul. 25, 2014 for AU Patent Application No. 2012346341, 3 pages.

* cited by examiner

SOURCE SPECTRUM CONTROL OF NONLINEARITIES IN OPTICAL WAVEGUIDES

BACKGROUND

This disclosure relates generally to operations performed and equipment utilized in conjunction with a subterranean well and, in an example described below, more particularly provides for source spectrum control of nonlinearities in optical waveguides.

Use of optical fibers in wells is known to those skilled in the art. Such optical fibers can be used, for example, to measured distributed temperature, strain, pressure, vibration and other parameters.

Unfortunately, the optical power in an optical fiber for such sensing purposes is limited, and is insufficient for higher power requirement operations in wells (e.g., cutting, ablating, conversion to other forms of energy, etc.). Therefore, it will be appreciated that improvements are needed in the art of transmitting optical power in a well.

SUMMARY

In the disclosure below, optical systems and methods are provided which bring improvements to the art of optical power transmission in wells. One example is described below in which optical power can be transmitted via a waveguide at a level greater than that which results in stimulated Raman or Brillouin scattering. Another example is described below in which multiple lasing elements are used to generate multiple spaced apart frequency ranges.

In one aspect, a method of delivering a desired relatively high optical power to a well tool in a subterranean well is provided to the art by the disclosure below. In one example, the method can include coupling to an optical waveguide an optical source which combines multiple optical frequency ranges, respective centers of the frequency ranges being separated by at least a peak shift frequency in a Raman gain spectrum for a corresponding pump wavelength generated by the optical source; and transmitting the desired optical power to the well tool via the optical waveguide positioned in the well.

In another aspect, a method of delivering optical power to a well tool in a subterranean well can, in one example, include coupling to an optical waveguide an optical source, the optical source comprising a sufficient number of lasing elements to transmit the optical power, with the optical power being greater than a critical power for stimulated Brillouin scattering in the waveguide.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
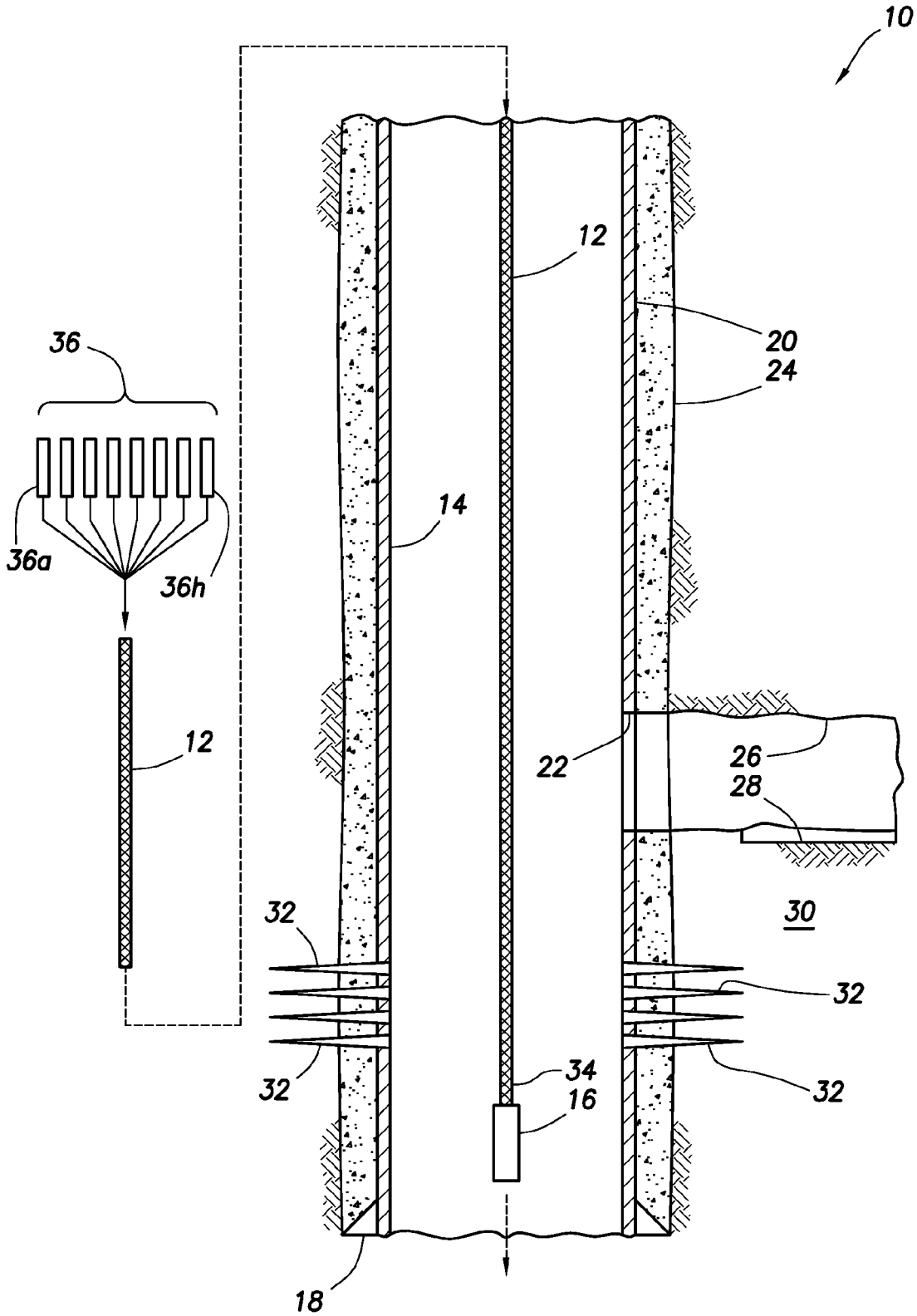
FIG. 1 is a representative partially cross-sectional view of a well system and associated method which can embody principles of this disclosure.

Representatively illustrated in FIG. 1 is an example of a system 10 and associated method for use with a subterranean well. The system 10 and method can embody principles of this disclosure, but it should be clearly understood that the scope of this disclosure is not limited to the details of the system and method as described herein or depicted in the drawings.

In the example of FIG. 1, an optical waveguide 12 is installed in a wellbore 14. The optical waveguide 12 could comprise one or more optical fibers, optical ribbons, or other types of optical waveguides. The waveguide 12 could be part of a cable (e.g., provided with armor, shielding, sealing material, hydrogen mitigation, etc.).

An optical well tool 16 is optically coupled to the waveguide 12. The tool 16 can be used to perform cutting or ablating operations, such as drilling the wellbore 14 past a shoe 18 of casing 20, cutting a window 22 through the casing and cement 24, drilling a branch wellbore 26 outwardly from the window, initiating a fracture 28 in an earth formation 30 penetrated by a wellbore, forming perforations 32 through the casing and cement, and into the formation, etc.

Any type of well operation which could utilize the optical energy transmitted by the waveguide 12 may be performed using the principles of this disclosure. Such operations are not limited to cutting and other ablating operations in which the optical energy is transmitted to a structure being ablated. In other examples, the optical energy could be converted to another type of energy (e.g., heat, kinetic energy, etc.), which can then be used for ablating, or to perform other functions.

For operations such as laser drilling, fracture 28 initiation, cutting windows 22 in metal casing 20, perforating, and other downhole processes or operations which benefit from a large amount of optical energy delivered to a distal end 34 of a long optical waveguide 12, optical nonlinearities such as stimulated Raman scattering (SRS) and stimulated Brillouin scattering (SBS) can significantly limit the amount of optical power delivered by the waveguide.

For these high optical power applications, many individual lasers or lasing elements 36*a-h* may be combined to form an optical source 36 at a remote location (such as, the earth's surface, a subsea facility, etc.) for generating the optical power launched into the waveguide 12 and delivered downhole. By combining lasing elements 36*a-h* with varying center wavelengths or frequencies, and increasing linewidths of the individual lasing elements, the wavelength or frequency dependent power spectrum of the combined lasing elements can be tailored to reduce optical nonlinearities, thus increasing the amount of power which can be launched at the remote location into a waveguide of a given core size.

This is advantageous, since smaller waveguides are easier to manufacture in long lengths, easier to handle and splice in the field, and generally more flexible and less expensive than larger core waveguides. Smaller waveguides can also be safely reeled onto smaller diameter spools without fatigue or breakage.

Implementation of the techniques disclosed here may also reduce the number of waveguides required to deliver the desired optical power. This would significantly reduce the cost of cables incorporating optical fibers to perform high power downhole processes, and would simplify their splicing in the field.

Optical communications technologies use wavelength division multiplexing (WDM) to increase a number of communication channels carried in a single optical fiber. One substantial difference between WDM and the principles of this disclosure is that WDM is used to increase the amount of information carried in an optical waveguide, but the principles of this disclosure can be used to increase the amount of optical power carried in an optical waveguide.

Stimulated Raman Scattering

Raman scattering is caused by the interaction of a pump photon (in this case produced by the optical source 36) with an individual molecule in a core of the waveguide 12. The usual result of a Raman scattering interaction is that some of the energy in the pump photon is transferred to a newly excited vibrational mode of the molecule.

The law of conservation of energy requires that all energy gained by the molecule is lost or given up by the original photon. Thus, a wavelength of the pump photon is lengthened, and this less-energetic, longer-wavelength photon is called a Stokes photon.

Typically 7 to 12 percent of the energy of a pump photon is lost when it is converted to a Stokes photon. In optical waveguide, the amount of energy lost is a function of the pump wavelength, the waveguide design and its chemical composition. The energy lost in conversion from pump to Stokes photons shows up as additional heat in the waveguide 12, and is undesirable if one wants to deliver a large amount of optical power at the end of the waveguide.

To reduce or eliminate this undesired energy dissipation, the principles of this disclosure can be used to mitigate the effects of SRS through control of an optical spectrum of the optical source 36.

Figure 2:
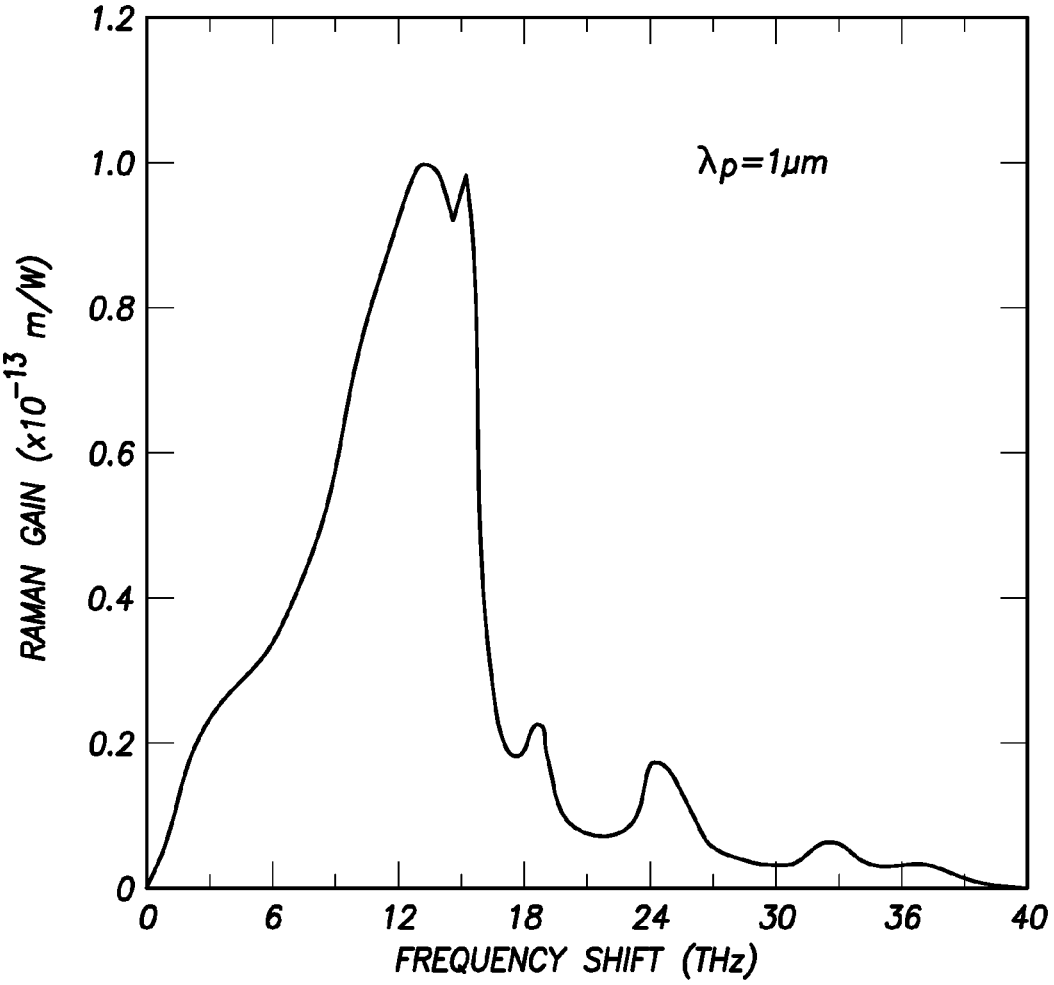
FIG. 2 is a representative graph of Raman gain versus frequency shift for a pump wavelength of 1 μm.

FIG. 2 is a representative plot of Raman gain, $g_R$ which is related to the probability that a photon will undergo Raman scattering when the pump or input laser wavelength $\lambda_p$ is 1 μm. The Raman gain spectrum shown in FIG. 2 is for fused silica.

This figure shows that the most probable shift is at a frequency around 13.2 THz, or a wavenumber of approximately 440 $cm^{-1}$ or 4.40×10−2 $\mu m^{-1}$. Note, also, that the maximum value of the Raman gain in FIG. 2 is approximately $1\times10^{-13}$ m/W.

Figure 4:
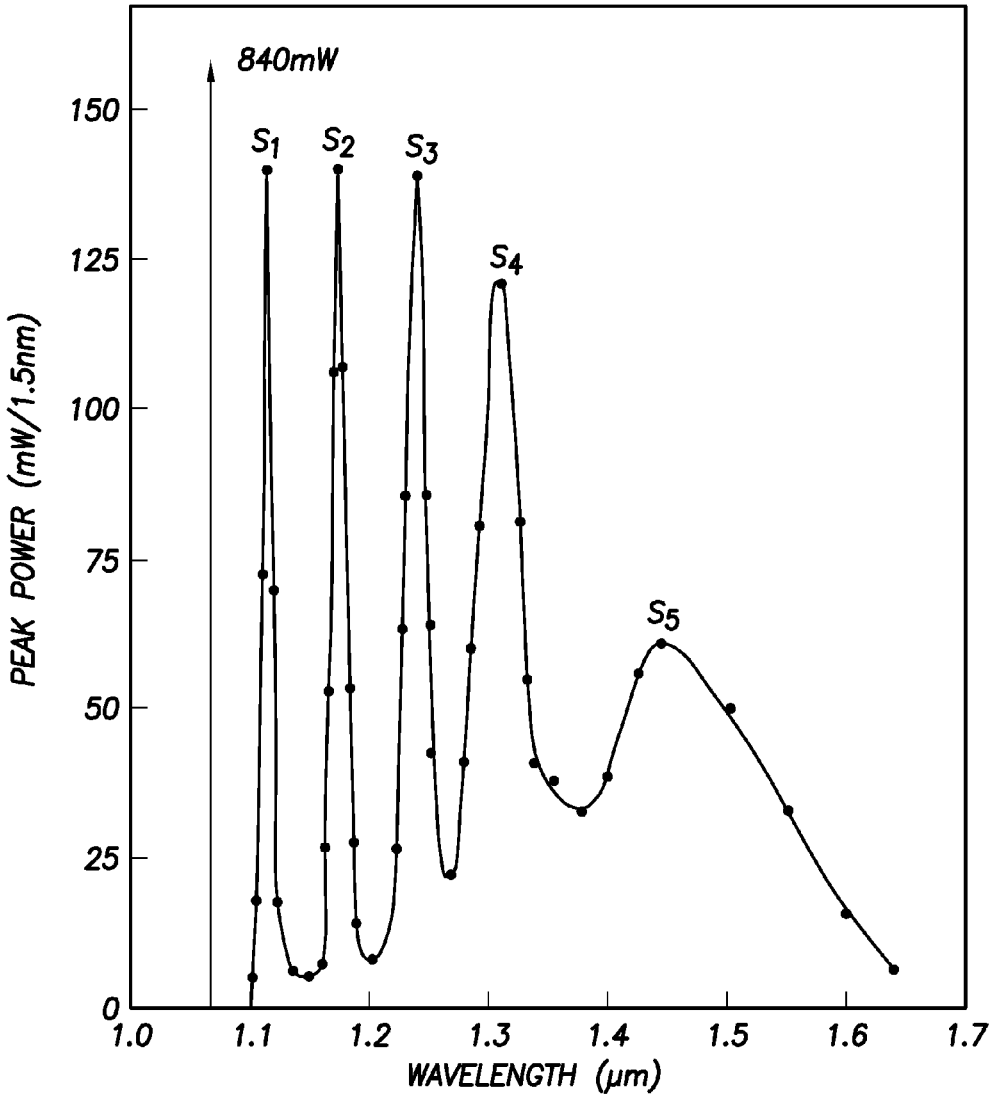
FIG. 4 is a representative graph of peak transmitted optical power versus wavelength.

Note that FIGS. 2 & 4 are derived from chapters 8 and 9 of Agrawal, G. P., *Nonlinear Fiber Optics,* 2d ed. (Academic Press, 1989).

The Raman gain and the peak Raman gain in fused silica can be estimated for other wavelengths by scaling the values in FIG. 2 with the inverse of the pump wavelength, $\lambda_p$. The Raman gain for different waveguide types will vary from the example illustrated in FIG. 2.

One can estimate the wavelength of the Stokes photons, $\lambda_S$, or the wavelength of the photons generated when pump photons with wavelength $\lambda_p$ undergo Raman scattering. Since we know the wavenumber shift for Raman scattering, estimating the wavenumber for the Stokes photons is a simple matter of subtracting the most probable Raman wavenumber shift from the wavenumber of the pump photons as given by the following equation:

$$\frac{1}{\lambda_S} = \frac{1}{\lambda_p} - 4.40\times10^{-2} = \frac{1-4.40\times10^{-2}\lambda_p}{\lambda_p}, \tag{1}$$

assuming the Stokes and pump wavelengths are expressed in units of micrometers. To find the Stokes wavelength, we simply take the reciprocal of Equation (1), $$\lambda_S = \frac{\lambda_p}{1-4.40\times10^{-2}\lambda_p}. \tag{2}$$

In reality, all Stokes photons will not have the same wavelength. Instead, they will undergo a range of shifts as implied in FIG. 2. However, since the Raman gain spectrum has a single, narrow, dominant peak, assuming a single Stokes wavelength is not unreasonable, and it simplifies the following development considerably.

Next, consider the distribution of, and interaction between, the pump and Stokes light along a waveguide in the z (longitudinal) direction. For coherent wave illumination, the irradiance (power per unit area) of the Stokes and pump signals, $I_S$ and $I_p$ respectively, are governed by the following pair of coupled, first order, nonlinear differential equations:

$$\frac{dI_S}{dz} = g_R I_p I_S - \alpha_S I_S \tag{3}$$

and $$\frac{dI_p}{dz} = -\frac{\lambda_S}{\lambda_p} g_R I_p I_S - \alpha_p I_p \tag{4}$$

where $\alpha_S$ and $\alpha_p$ are the exponential absorption coefficients for the Stokes and pump wavelengths, respectively.

These equations imply that the conversion of pump to Stokes photons is proportional to the product of the Raman gain coefficient and the irradiances of the Stokes and pump wavelengths. If either irradiance is low, there is little Raman conversion. If the Stokes irradiance is low and the pump irradiance is high, the Stokes irradiance will increase at the expense of the pump irradiance.

The ratio of the wavelengths in the first term on the right-hand side of Equation (4) accounts for the change in energy carried by each Stokes and pump photon. The initial pump photons carry more energy than the Stokes photons they become because they have a shorter wavelength.

Assuming that $\alpha_S=\alpha_p=\alpha$, Equations (3) and (4) become $$\frac{dI_S}{dz} = g_R I_p I_S - \alpha I_S \tag{5}$$

and $$\frac{dI_p}{dz} = -\frac{\lambda_S}{\lambda_p} g_R I_p I_S - \alpha I_p. \tag{6}$$

Equations (5) and (6) form a system of first order coupled linear differential equations which may be solved numerically to estimate the distribution of pump and Stokes photons along the length of an optical waveguide.

Figure 3:
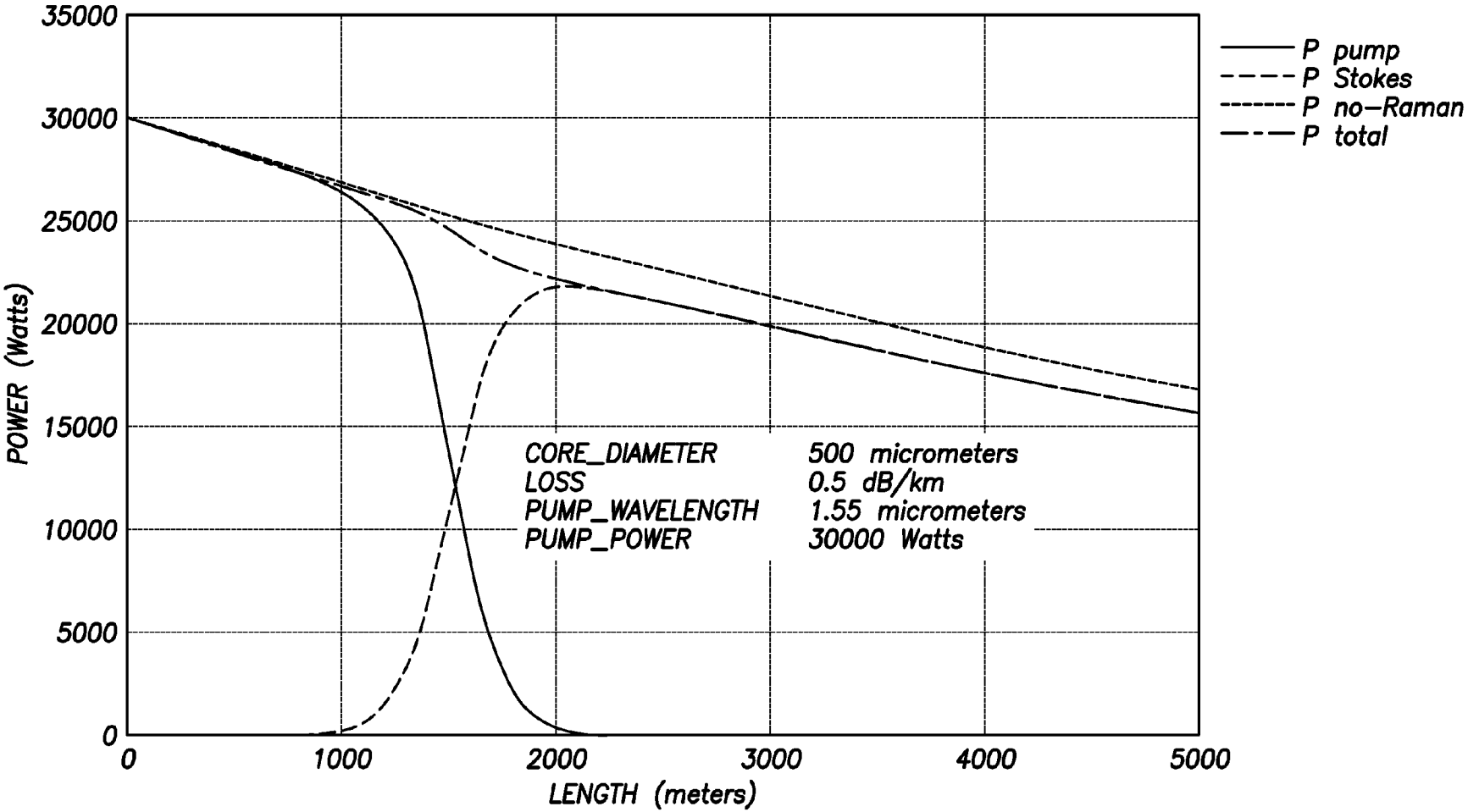
FIG. 3 is a representative graph of optical power versus waveguide length.

Referring additionally now to FIG. 3, numerical results of an example solution of Equations (5) and (6) for a 500 μm waveguide core diameter, an input power of 30 kW, 0.5 db/km Loss and 1.55 μm pump wavelength are representatively illustrated. Note that complete Raman conversion occurs at a distance of approximately 2 km, and approximately 7% of the power is lost.

Note, also, that at 2 km the Stokes power is in excess of 20 kw, and this power level may be sufficient to produce a second generation Raman conversion, again losing approximately 7% of optical power.

FIG. 4 representatively illustrates an example output optical spectrum resulting from the waveguide being illuminated with high power at a wavelength of 1.07 μm. Note in FIG. 4 that a total of five Raman conversions, $S_{1-5}$ occurs, each with increasing wavelength.

One way to eliminate SRS in a waveguide is to reduce the initial irradiance of the pump optical power fed into the waveguide. Irradiance is power per unit area, so irradiance can be reduced by either reducing the input power or increasing the diameter or area of the core region of the waveguide.

Figure 5:
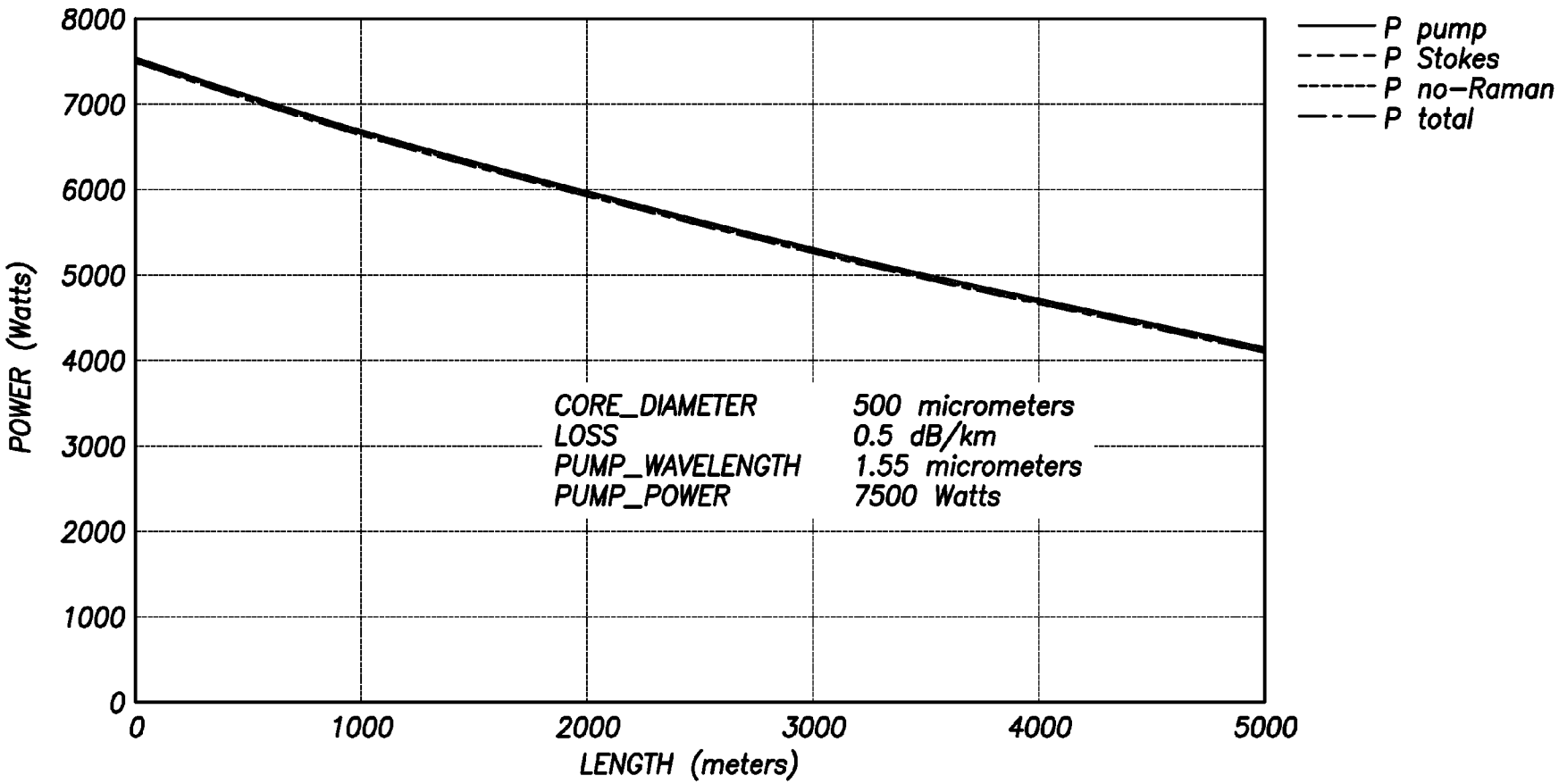
FIG. 5 is another representative graph of optical power versus waveguide length.
Figure 6:
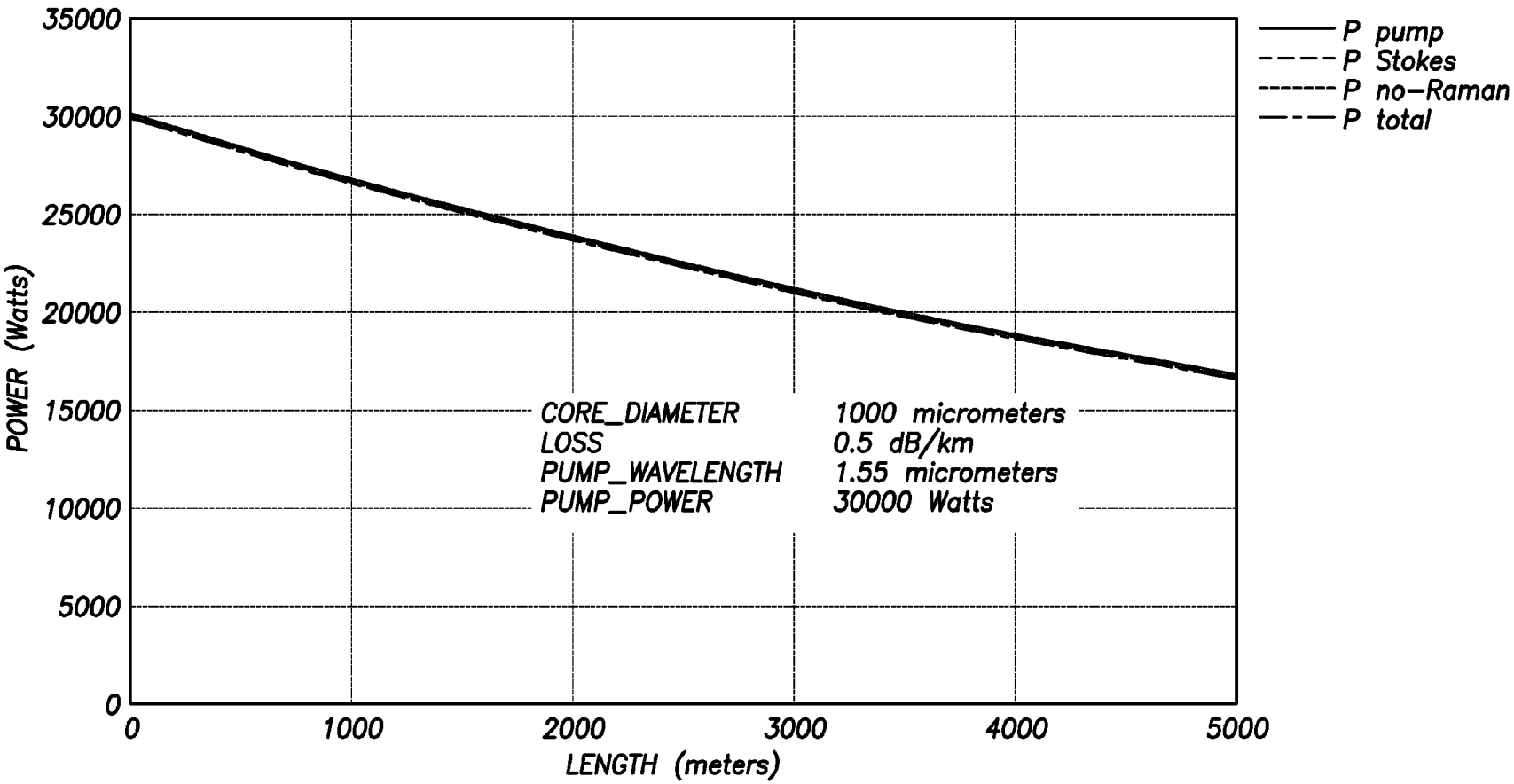
FIG. 6 is yet another representative graph of optical power versus waveguide length.

An example of the effectiveness of reducing the irradiance of the optical source is representatively illustrated in FIGS. 5 & 6. FIG. 5 depicts the distribution of pump and Stokes power (P pump and P Stokes, respectively) for circumstances similar to that in FIG. 3, but with the total power (P total) reduced to 7.5 kW. Note that, at this power level, Stokes power remains essentially zero along the waveguide.

FIG. 6 illustrates another similar example, with 30 kW input power, but a 1000 μm core. Once again, no SRS is observed.

In FIGS. 5 & 6, the initial irradiance is reduced from that in FIG. 3 by a factor of four and the result is elimination of SRS. Unfortunately, reducing the initial power or increasing the waveguide size is not an attractive option for the delivery of high optical powers over long distances.

However, there is a critical optical power ($Pcr_R$), below which SRS for a pump wavelength or frequency is not significant. This critical optical power $Pcr_R$ is given by the following equation:

$$Pcr_R \approx \frac{16A}{g_R L_{eff}} \tag{7}$$

where A is the area of the waveguide core. The effective fiber length $L_{eff}$ is related to the physical length L of the waveguide, and its attenuation coefficient α is given by the following equation:

$$L_{eff}=(1-\exp(-\alpha L))/\alpha \tag{8}$$

Note, from equations 7 & 8, that:

a) critical power for SRS increases with core size or area, and decreases with increasing Raman gain and effective length, and b) effective length increases with physical length and decreases with attenuation.

In the FIG. 2 example, increasing the power introduced into the waveguide 12, while avoiding or at least significantly reducing the effects of SRS, can be achieved by distributing the incident power into varying groups of wavelengths or frequencies, which are separated by frequencies greater than the peak shift shown in the Raman gain spectrum. As depicted in FIG. 2, the peak shift occurs at approximately 13 THz, with a full width at half maximum (FWHM) of approximately 6 THz.

Figure 7:
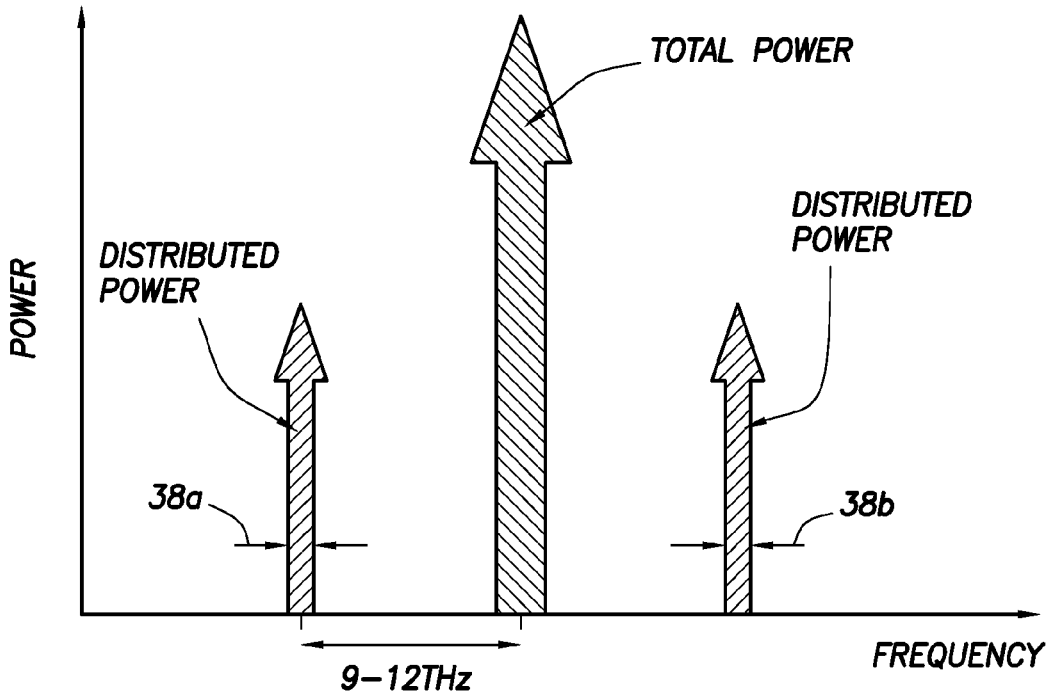
FIG. 7 is a representative graph of optical power versus frequency.

As illustrated schematically in FIG. 7, SRS can be eliminated or significantly reduced for the FIG. 2 example by dividing the power introduced into the waveguide 12 into two or more wavelength or frequency ranges 38*a,b* separated by a difference of approximately 18-24 THz, so that Raman interactions between the frequency bands are unlikely.

This reduces SRS, because the power in each frequency range 38*a,b* can be less than the critical power $Pcr_R$ required to initiate SRS, while the total power in the waveguide 12 can be significantly greater than that required to initiate SRS (if all power was contained at or near a single wavelength). Although two frequency ranges 38*a,b* are depicted in FIG. 7, any number of frequency ranges may be used (for example, lasing elements 36*a-h* could each emit a separate frequency range).

Figure 8:
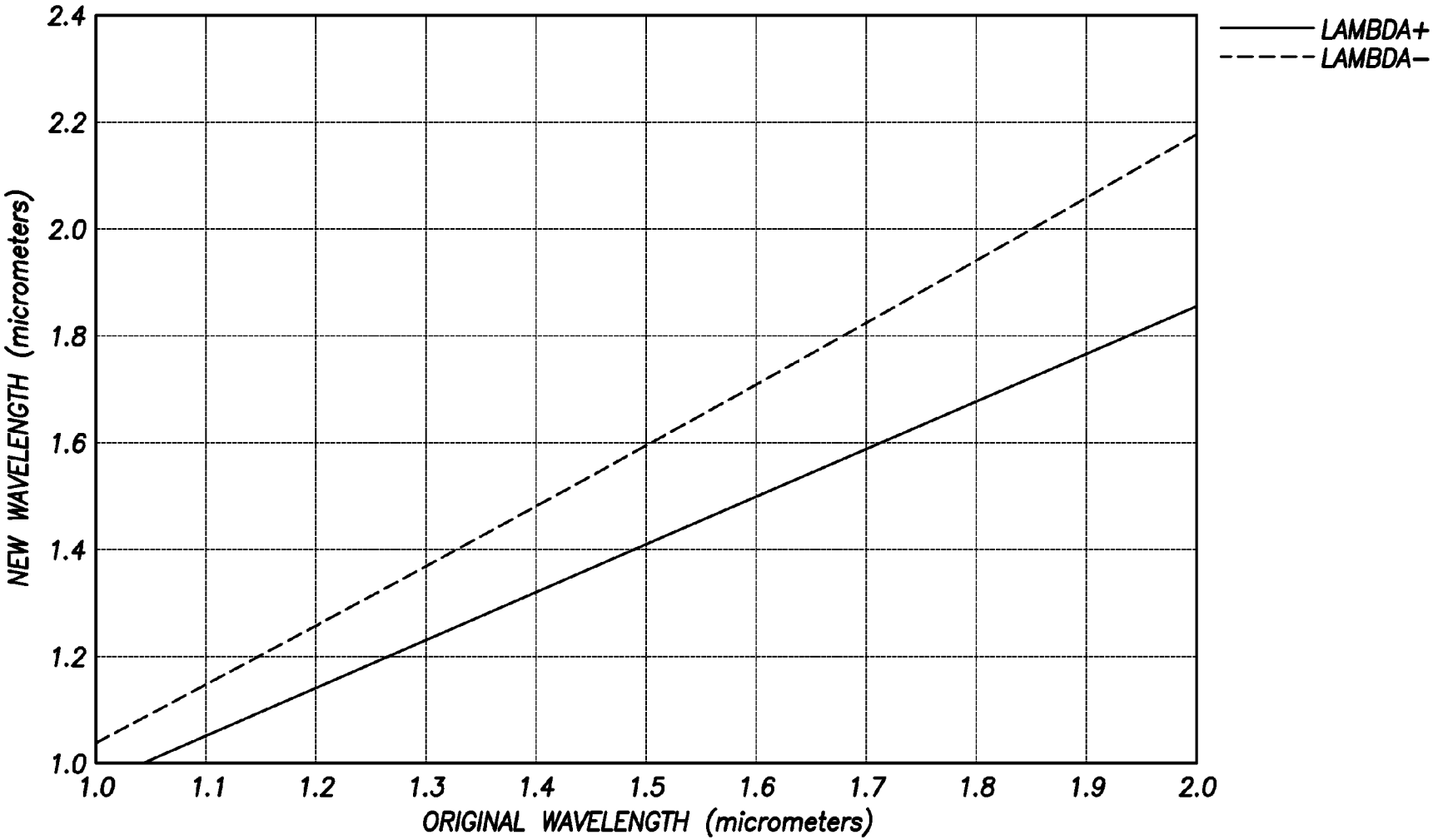
FIG. 8 is a representative graph of offset wavelengths.

FIG. 8 depicts an example graph of two wavelengths, each separated from the other by 24 THz, for a range of original wavelengths. Any separation between wavelength or frequency ranges may be used, as desired.

Stimulated Brillouin Scattering

Another commonly encountered nonlinearity which may limit the amount of optical power one can transmit is SBS, which occurs when standing optical fields generate temporary, traveling, periodic variations in a refractive index of a waveguide. This periodic variation in refractive index is due to electrostriction, and acts similar to a Bragg grating (or more specifically, a fiber Bragg grating).

SBS may be more limiting and potentially more dangerous than SRS, since it can occur with lower irradiance. More importantly, SBS photons travel in a direction opposite to the pump photons. If strong SBS is present, a laser beam transmitted into a waveguide will be reflected back toward its source.

If tens of kilowatts of optical power are transmitted through a waveguide, kilowatts will return to the optical source 36 with strong SBS. This high reflected power can destabilize or damage the optical source 36 and may pose a hazard to equipment and personnel at the transmitting (surface) end of the waveguide.

In contrast with SRS, the frequency shift for SBS Stokes photons is small (on the order of 10-11 GHz, with a FWHM of approximately 0.1 GHz), hence there is very little change in energy in the SBS Stokes photon. But since its direction in a waveguide 12 is changed 180 degrees, all the power of each Stokes photon is lost from the incident beam.

The onset of SBS can be estimated from an expression similar to Equation (7) for SRS. There is a critical power $Pcr_B$, below which SBS for one pump wavelength or frequency is not significant. This critical power is given by the following equation:

$$Pcr_B \approx \frac{21A}{g_B L_{eff}} \tag{9}$$

where $g_B$ is the Brillouin gain. Brillouin gain $g_B$ is approximately $5\times10^{-11}$ m/W for a pump wavelength of 1.55 μm, or about three orders of magnitude greater than the Raman gain $g_R$. For this reason, SBS can occur at a much lower irradiance than SRS, and is usually the limiting optical nonlinearity.

Fortunately, Brillouin gain is inversely proportional to the linewidth of a lasing element 36*a-h*. In fact, Brillouin gain scales with the ratio of $\nu_s/\nu_B$, where $\nu_s$ is the FWHM of the source spectrum and $\nu_B$ is the FWHM of the Brillouin gain.

If the optical source 36 spectrum is wide enough, Brillouin gain can be reduced to a level comparable with Raman gain. Therefore, broadening and breaking up the optical source 36 spectrum as described above can reduce SBS, as well as SRS, and the power transmitted through the waveguide 12 can be substantially increased, without limiting nonlinearities.

As mentioned above, the FWHM of the Brillouin gain is on the order of 0.1 GHz, so if the source spectrum is broadened to on the order of 100 GHz (0.1 THz), the Brillouin gain is decreased by three orders of magnitude (on a similar level with SRS).

Figure 9:
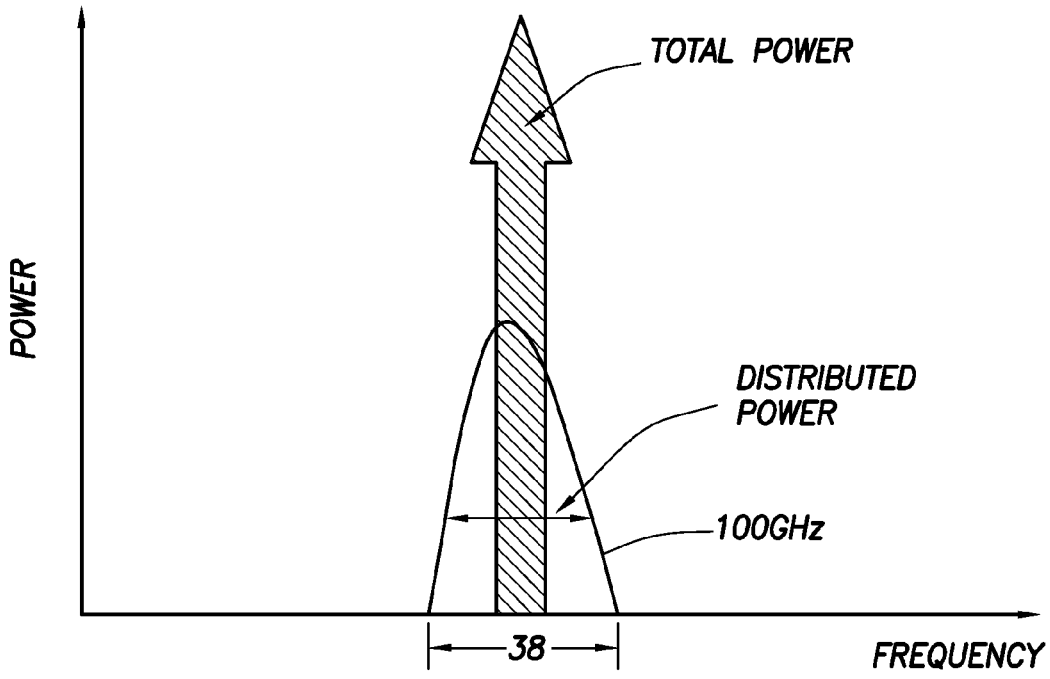
FIG. 9 is another representative graph of optical power versus frequency.

An example of this broadening of the source 36 spectrum to reduce SBS is representatively illustrated in FIG. 9. Two methods of broadening the source 36 spectrum are depicted in FIG. 9. Since many individual lasing elements 36*a-h* can be used to generate the desired power, the wavelengths generated by the group of lasing elements can be varied, so that the delivered optical power is spread over a relatively wide range of frequencies.

If the frequency range 38 of the combined lasing elements 36*a-h* is insufficient to adequately broaden the source 36 spectrum, the spectrum may be further distributed by modulation of the lasing elements 36*a-h*. Phase modulation is currently preferred over amplitude or frequency modulation for this application. Those skilled in the art are aware of a number of well-known techniques to modulate the lasing elements 36*a-h*.

Figure 10:
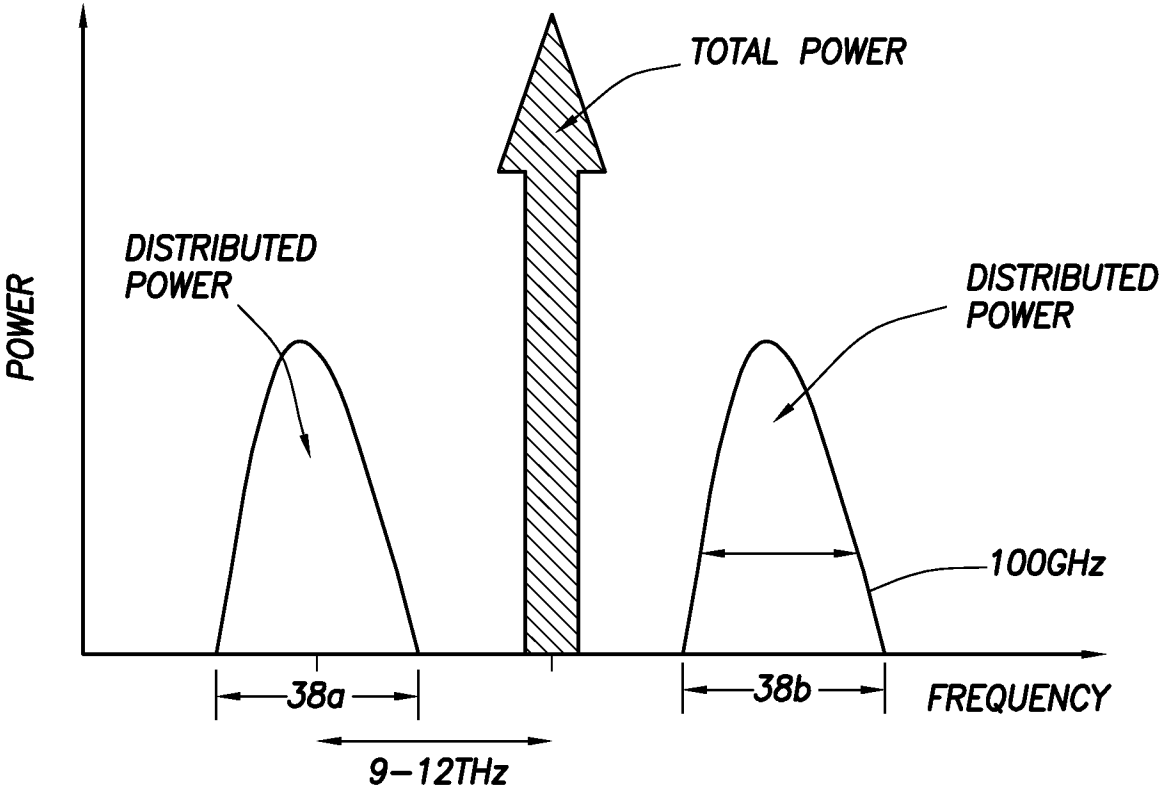
FIG. 10 is yet another representative graph of optical power versus frequency.

Referring additionally now to FIG. 10, an example optical source 36 spectrum is representatively illustrated. The source 36 spectrum is designed to minimize both SRS and SBS. Note that the optical power is distributed over relatively broad frequency ranges 38*a,b*, and the frequency ranges are separated by 18-24 THz.

This distribution of power in the source 36 spectrum is readily achieved through the use of multiple source lasing elements 36*a-h*, each emitting varying frequencies. In FIG. 10, the transmitted optical power is divided into frequency ranges 38*a,b*, none of which contain sufficient power to result in SRS.

The linewidths of the frequency ranges 38*a,b* are broad enough to avoid SBS. Therefore, a source 36 spectrum similar to that depicted in FIG. 10 should be useful in transmitting high optical power along long waveguides, while mitigating SRS and SBS effects.

It may now be fully appreciated that this disclosure provides significant advancements to the art of utilizing optical waveguides in wells. The principles described above allow more optical power to be transmitted through a given waveguide than more conventional single frequency or wavelength approaches.

In order to generate tens of kilowatts of optical power, hundreds or thousands of individual lasing elements 36*a*- . . . can be combined in the optical source 36. Using the principles of this disclosure, it is more convenient and less expensive to let the frequencies of these individual lasing elements 36*a*- . . . vary, rather than keeping them all the same. This makes very high power optical sources for downhole applications less expensive.

Thus, a smaller, less expensive waveguide/cable can be used, and a less expensive optical source 36 can be used. This can improve the economics and customer acceptance of utilizing high power optical well tools 16.

The above disclosure provides to the art a method of delivering a desired relatively high optical power to a well tool 16 in a subterranean well. In one example, the method can include coupling to an optical waveguide 12 an optical source 36 which combines multiple optical frequency ranges 38*a,b*, respective centers of the frequency ranges 38*a,b* being separated by at least a peak shift frequency in a Raman gain $g_R$ spectrum for a corresponding pump wavelength $\lambda_p$ generated by the optical source 36; and transmitting the desired optical power to the well tool 16 via the optical waveguide 12 positioned in the well.

The method can include coupling multiple lasing elements 36*a-h* to the waveguide 12, each of the lasing elements 36*a-h* generating a corresponding at least one of the frequency ranges 38*a,b*.

An optical frequency generated by each of the lasing elements 36*a-h* may vary during the transmitting. The optical frequency may be varied by one or more of phase modulation, amplitude modulation and frequency modulation.

The method can include coupling a sufficient number of lasing elements 36*a-h* to the waveguide 12 to transmit the desired optical power, with the desired optical power being greater than a critical power Pcr for stimulated Raman scattering, and/or for stimulated Brillouin scattering.

The method can include ablating a structure in the well, in response to the transmitting. The structure may comprise at least one of a casing 20, an earth formation 30 and cement 24.

The method can include forming a window 22 through casing 20, drilling a wellbore 14, 26, forming perforations 32 and/or initiating a fracture 28 using the transmitted optical power.

Also described above is a method of delivering optical power to a well tool 16 in a subterranean well, with the method comprising: coupling to an optical waveguide 12 an optical source 36, the optical source 36 comprising a sufficient number of lasing elements 36*a-h* to transmit the optical power, with the optical power being greater than a critical power $Pcr_B$ for stimulated Brillouin scattering in the waveguide 12; and transmitting the optical power to the well tool 16 via the optical waveguide 12 positioned in the well.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments. This disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A method of delivering a desired relatively high optical power to a well tool in a subterranean well, the method comprising:

coupling to an optical waveguide an optical source which combines multiple optical frequency ranges, respective centers of the frequency ranges being separated by at least a peak shift frequency in a Raman gain spectrum for a corresponding pump wavelength generated by the optical source; and transmitting the desired optical power to the well tool via the optical waveguide positioned in the well.

2. The method of claim 1, wherein coupling further comprises coupling multiple lasing elements to the waveguide, each of the lasing elements generating a corresponding at least one of the frequency ranges.

3. The method of claim 2, wherein an optical frequency generated by each of the lasing elements varies during the transmitting.

4. The method of claim 3, wherein the optical frequency is varied by at least one of phase modulation, amplitude modulation and frequency modulation.

5. The method of claim 1, wherein coupling further comprises coupling a sufficient number of lasing elements to the waveguide to transmit the desired optical power, with the desired optical power being greater than a critical power for stimulated Raman scattering.

6. The method of claim 1, wherein coupling further comprises coupling a sufficient number of lasing elements to the waveguide to transmit the desired optical power, with the desired optical power being greater than a critical power for stimulated Brillouin scattering.

7. The method of claim 1, further comprising ablating a structure in the well, in response to the transmitting.

8. The method of claim 7, wherein the structure comprises at least one of a casing, an earth formation and cement.

9. The method of claim 1, further comprising forming a window through casing using the transmitted optical power.

10. The method of claim 1, further comprising drilling a wellbore using the transmitted optical power.

11. The method of claim 1, further comprising forming perforations using the transmitted optical power.

12. The method of claim 1, further comprising initiating a fracture using the transmitted optical power.

13. A method of delivering optical power to a well tool in a subterranean well, the method comprising:

coupling to an optical waveguide an optical source, the optical source comprising a sufficient number of lasing elements to transmit the optical power, with the optical power being greater than a critical power for stimulated Brillouin scattering in the waveguide, wherein the lasing elements generate respective optical frequency ranges, respective centers of the frequency ranges being separated by at least a peak shift frequency in a Raman gain spectrum for a corresponding pump wavelength generated by the optical source; and transmitting the optical power to the well tool via the optical waveguide positioned in the well.

14. The method of claim 13, wherein an optical frequency generated by each of the lasing elements varies during the transmitting.

15. The method of claim 14, wherein the optical frequency is varied by at least one of phase modulation, amplitude modulation and frequency modulation.

16. The method of claim 13, wherein the optical power is greater than a critical power for stimulated Raman scattering.

17. The method of claim 13, further comprising ablating a structure in the well, in response to the transmitting.

18. The method of claim 17, wherein the structure comprises at least one of a casing, an earth formation and cement.

19. The method of claim 13, further comprising forming a window through casing using the transmitted optical power.

20. The method of claim 13, further comprising drilling a wellbore using the transmitted optical power.

21. The method of claim 13, further comprising forming perforations using the transmitted optical power.

22. The method of claim 13, further comprising initiating a fracture using the transmitted optical power.

* * * * *